US007891298B2

(12) United States Patent
Minick et al.

(10) Patent No.: US 7,891,298 B2
(45) Date of Patent: Feb. 22, 2011

(54) GUIDED PROJECTILE

(75) Inventors: Alan B. Minick, Madison, AL (US); Stephen Alan Hobart, Huntsville, AL (US); Frederick Widman, Madison, AL (US); Timothy S. Kokan, Madison, AL (US); Frederic H. Massey, Tullahoma, TN (US)

(73) Assignee: Pratt & Whitney Rocketdyne, Inc., Canoga Park, CA (US)

( * ) Notice: Subject to any disclaimer, the term of this patent is extended or adjusted under 35 U.S.C. 154(b) by 342 days.

(21) Appl. No.: 12/120,355

(22) Filed: May 14, 2008

(65) Prior Publication Data

US 2010/0307367 A1 Dec. 9, 2010

(51) Int. Cl.
*F42B 10/00* (2006.01)

(52) U.S. Cl. ..... 102/501; 102/490; 102/375; 244/3.15; 244/3.22

(58) Field of Classification Search ..... 102/501, 102/490, 375; 244/3.15, 3.22
See application file for complete search history.

(56) References Cited

U.S. PATENT DOCUMENTS

| | | | | |
|---|---|---|---|---|
| 46,490 | A | | 2/1865 | Orwig |
| 279,539 | A | * | 6/1883 | Chamberlain ..... 102/375 |
| 412,670 | A | | 10/1889 | Ross |
| 1,243,542 | A | | 10/1917 | Moore |
| 1,277,942 | A | | 9/1918 | Kaylor |
| 1,373,966 | A | | 4/1921 | Keyser |
| 2,027,892 | A | | 1/1936 | Williams |
| 2,090,656 | A | | 4/1937 | Williams |
| 2,090,657 | A | | 8/1937 | Williams |
| 2,176,469 | A | | 10/1939 | Moueix |
| 2,336,146 | A | | 8/1944 | Loomis |
| 2,516,926 | A | | 8/1950 | Simpson |
| 2,579,823 | A | | 12/1951 | Homrighous |
| 2,847,787 | A | | 8/1958 | Willams |
| 2,920,537 | A | | 1/1960 | Simmons |
| 3,018,203 | A | | 1/1962 | Guth |
| 3,125,313 | A | | 3/1964 | Soderberg |
| 3,224,191 | A | | 12/1965 | Bratton |
| 3,282,540 | A | | 11/1966 | Lipinski |
| 3,392,396 | A | | 7/1968 | Ehrenspeck |
| 3,494,285 | A | | 2/1970 | Doris, Jr. |
| 3,547,001 | A | | 12/1970 | Stoner |
| 3,628,457 | A | | 12/1971 | Magnusson |
| 3,698,321 | A | | 10/1972 | Wall |
| 3,754,507 | A | | 8/1973 | Dillinger et al. |

(Continued)

FOREIGN PATENT DOCUMENTS

| | | |
|---|---|---|
| AR | 1373405 | 11/1974 |

(Continued)

OTHER PUBLICATIONS

Small Caliber Ammunition.

(Continued)

*Primary Examiner*—J. Woodrow Eldred
(74) *Attorney, Agent, or Firm*—Carlson, Gaskey & Olds P.C.

(57) ABSTRACT

A non-propulsive projectile and method of maneuvering the non-propulsive projectile. The non-propulsive projectile includes a divert system with a multiple of valves to maneuver the projectile in response to a control system.

23 Claims, 7 Drawing Sheets

U.S. PATENT DOCUMENTS 3,850,102 A 11/1974 Morrow
3,860,199 A 1/1975 Dunne
3,886,009 A 5/1975 Puchalski
3,951,038 A 4/1976 Van Langenhoven
3,961,580 A 6/1976 Burnett et al.
3,977,629 A * 8/1976 Tubeuf ..... 244/3.22
3,988,990 A 11/1976 MacDonald, Jr. et al.
4,003,313 A 1/1977 Puchalski
4,091,732 A 5/1978 Schadow
4,130,061 A 12/1978 Boggs et al.
4,176,487 A 12/1979 Manis
4,176,814 A 12/1979 Albrektsson et al.
4,179,088 A 12/1979 French
4,213,393 A 7/1980 Gunners et al.
4,332,468 A 6/1982 Stiizle
4,379,531 A 4/1983 Manis
4,388,867 A 6/1983 Baumer
4,407,465 A 10/1983 Meyerhoff
4,428,293 A 1/1984 Botwin et al.
4,431,150 A 2/1984 Epperson, Jr.
4,460,137 A 7/1984 Andersson et al.
4,476,785 A 10/1984 Hoffman et al.
4,502,649 A 3/1985 Botwin et al.
4,537,371 A * 8/1985 Lawhorn et al. ..... 244/3.22
4,546,940 A 10/1985 Andersson et al.
4,554,872 A 11/1985 Schleicher
4,591,865 A 5/1986 Canal
4,641,802 A 2/1987 Zalmon et al.
4,648,567 A 3/1987 Maudal et al.
4,679,748 A 7/1987 Blomqvist et al.
4,691,633 A 9/1987 Godfrin et al.
4,709,142 A 11/1987 Dahl
4,711,152 A 12/1987 Fortunko
4,712,465 A 12/1987 MacDonald
4,722,261 A 2/1988 Titus
4,726,279 A 2/1988 Kepler et al.
4,733,609 A 3/1988 Goodwin et al.
4,735,148 A 4/1988 Holtzman et al.
4,756,252 A 7/1988 Melhus et al.
4,760,794 A 8/1988 Allen
4,807,532 A 2/1989 Andersson et al.
4,807,535 A 2/1989 Schilling et al.
4,813,635 A 3/1989 Paterson et al.
4,846,071 A 7/1989 Franzen et al.
4,893,815 A 1/1990 Rowan
4,899,956 A 2/1990 King et al.
4,913,029 A 4/1990 Tidman et al.
4,925,129 A 5/1990 Salkeld et al.
4,936,216 A 6/1990 Skagerlund
4,965,453 A 10/1990 Hoschette et al.
4,987,832 A 1/1991 Klink et al.
5,014,621 A 5/1991 Fox et al.
5,056,436 A 10/1991 Greene
5,058,503 A 10/1991 Adams
5,076,053 A 12/1991 McVey et al.
5,099,246 A 3/1992 Skagerlund
5,131,602 A 7/1992 Linick
5,163,637 A 11/1992 Hansen
5,230,656 A 7/1993 Paterson et al.
5,280,751 A 1/1994 Muirhead et al.
5,282,588 A 2/1994 August
5,309,815 A 5/1994 Moller et al.
5,372,334 A 12/1994 Cuadros
5,374,013 A 12/1994 Bassett et al.
5,381,445 A 1/1995 Hershey et al.
5,381,736 A 1/1995 Kalcic
5,414,430 A 5/1995 Hansen
5,419,982 A 5/1995 Tura et al.
5,425,514 A 6/1995 Grosso
5,449,136 A 9/1995 Doria Iriarte
5,455,587 A 10/1995 Schneider
5,529,262 A 6/1996 Horwath
5,529,458 A 6/1996 Humpherson
5,601,255 A 2/1997 Romer et al.
5,647,559 A 7/1997 Romer et al.
5,662,291 A 9/1997 Sepp et al.
5,669,581 A 9/1997 Ringer
5,788,178 A 8/1998 Barrett, Jr.
5,798,478 A 8/1998 Beal
5,909,782 A 6/1999 Pluff et al.
5,932,836 A 8/1999 White
6,213,023 B1 4/2001 Gunners
6,230,630 B1 5/2001 Gibson et al.
6,405,653 B1 6/2002 Miskelly
6,422,507 B1 7/2002 Lipeles
6,443,391 B1 9/2002 Malejko et al.
6,474,593 B1 * 11/2002 Lipeles et al. ..... 244/3.21
6,515,846 B1 2/2003 Tripp
6,608,464 B1 8/2003 Lew et al.
6,615,739 B2 9/2003 Gibson et al.
RE38,261 E 10/2003 White
6,629,669 B2 10/2003 Jensen
6,634,700 B1 10/2003 Calvert
6,655,293 B1 12/2003 Henry et al.
6,727,485 B2 4/2004 Rastegar et al.
6,796,533 B2 9/2004 Barrett et al.
6,799,518 B1 10/2004 Williams
6,805,325 B1 10/2004 Malmuth et al.
6,923,123 B2 8/2005 Rastegar et al.
6,923,404 B1 8/2005 Liu et al.
6,926,345 B2 8/2005 Ortega et al.
6,935,242 B2 8/2005 Rastegar et al.
6,982,402 B1 1/2006 Rastegar et al.
7,002,126 B2 2/2006 Gnemmi et al.
7,079,070 B2 7/2006 Kongelbeck et al.
7,089,865 B2 8/2006 Regev
7,090,163 B2 8/2006 Rastegar et al.
7,100,514 B2 9/2006 LeBourgeois
7,121,210 B2 10/2006 Steele
7,150,232 B1 12/2006 Rastegar et al.
7,190,304 B1 3/2007 Calson
7,255,044 B2 8/2007 Rastegar et al.
7,255,304 B2 8/2007 Ericson et al.
7,255,387 B2 8/2007 Wood
7,302,773 B2 12/2007 Rozhkov et al.
2003/0056639 A1 3/2003 Giza
2004/0237825 A1 12/2004 Ronn et al.

FOREIGN PATENT DOCUMENTS

DE 1037743 5/1963
FR 510303 2/1920
GB 0147104 7/1920
GB 1221203 2/1971
LU 1286723 8/1972

OTHER PUBLICATIONS

Large-Area Electrostatic-Valved Skins for Adaptive Flow Control on Ornithopter Wings, Liger, Pornsin-Sirirak, Tai, Steve Ho, and Chih-Ming Ho, Solid-State Sensor, Actuator and Microsystems Workshop, Jun. 2-6, 2002, pp. 247-250.
Appendix A, Gun Propulsion Technology, pp. 210-224.
Appendix B, Estimation of Liquid Jet Velocities, pp. 225-232.
Appendix C, Background Theory of Optical Method for Compressible Flows, pp. 233-247.
Appendix D, Shock Wave Theory, pp. 248-259.
Bullet Composition and Characteristics, pp. 1-13.
RDT&E Budget Item Justification Sheet, Feb. 2007, pp. 351-369.
A System-of-Systems Design of a Guided Projectile Mortar Defense System, Kevin Massey, Michael Heiges, Ben Difrancesco, Tommer Ender, and Dimitri Mavris, American Institute of Aeronautics and Astronautics, Inc., pp. 1-16.
Exacto, Lyndall Beamer, DARPA/IXO.

Injection into a Supersonic Stream, EX228, Application Briefs from Fluent.

Guided Bullets: A Decade of Enabling Adaptive Materials R&D, Dr. Ron Barrett, Dr. Gary Lee.

Maximizing Missile Flight Performance, Eugene L. Fleeman, Georgia Institute of Technology.

MScSuite Ammunition Systems 2 Delivery Systems External Ballistics Drag, Dr. Derek Bray, DAPS, pp. 1-37.

Stability Derivatives, Zlatko Petrovic, May 13, 2002, pp. 1-63.

U.S. Appl. No. 12/120,345, filed May 14, 2008, "Extended Range Projectile".

* cited by examiner

GUIDED PROJECTILE

BACKGROUND

The present application relates to projectiles, and more particularly to a guided non-propulsive projectile.

The accuracy of conventional non-propulsive projectiles such as bullets, shells, mortars, or other non-propulsive aeroshells are limited by many external factors such as wind, altitude, and humidity. Targeting systems compensate for the effect of external factors and adjust an aim point such that the ballistic trajectory of the projectile will intersect a target. Although effective, targeting system operation is further complicated as the external factors and behavior of the target can change after the projectile has been launched.

The ability of the projectile to maneuver after launch through a maneuver system in response to a guidance system operates to minimize or negate these factors and increase projectile accuracy. Conventional maneuver systems often employ aerodynamic surfaces that deploy after launch. Although effective, these maneuver systems may increase drag, reduce projectile range and increase complexity of the projectile, especially in a gun-launched configuration which requires the aerodynamic surface to deploy. As such, conventional maneuver systems are typically limited to larger caliber weapon systems.

SUMMARY

A divert system for a non-propulsive projectile according to an exemplary aspect of the present invention includes a multiple of valves in communication with an accumulation manifold and a nozzle downstream of each of the multiple of valves.

A non-propulsive projectile according to an exemplary aspect of the present invention includes: a multiple of valves in communication with an accumulation manifold to selectively release a working fluid through at least one of the multiple of valves to maneuver the projectile in response to a control system.

A method of maneuvering a non-propulsive projectile according to an exemplary aspect of the present invention includes: releasing a working fluid from a storage tank contained within a projectile through a divert system which provides a selective communication path for the working fluid to maneuver the projectile in response to a control system.

BRIEF DESCRIPTION OF THE DRAWINGS

The various features and advantages of this invention will become apparent to those skilled in the art from the following detailed description of the disclosed non-limiting embodiment. The drawings that accompany the detailed description can be briefly described as follows.

DETAILED DESCRIPTION OF THE EXEMPLARY EMBODIMENTS

Figure 1:
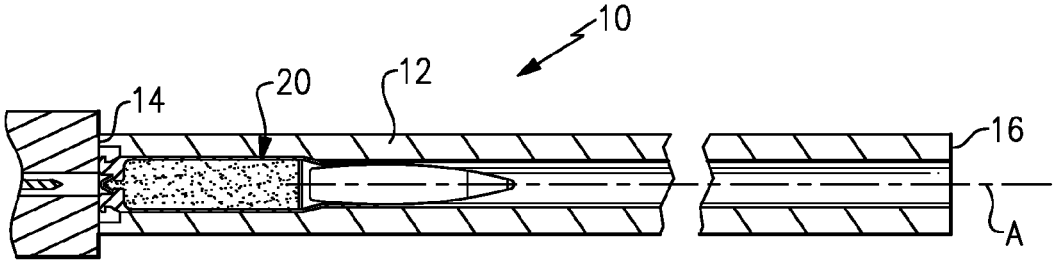
FIG. 1 is a is a partial cut away longitudinal cross-sectional view of an ammunition round including an extended range projectile according to one non-limiting embodiment of the invention chambered in a weapon.

FIG. 1 schematically illustrates an exemplary weapon system 10 which generally includes a barrel 12 which extends from a chamber 14 to a muzzle 16. The barrel 12 extends along a longitudinal axis A and may include a rifled or smooth bore. The illustrated weapon is illustrated in a highly schematic fashion and is not intended to be a precise depiction of a weapon system but is typical of a firearm or cannon which fires an ammunition round 20.

Figure 2:
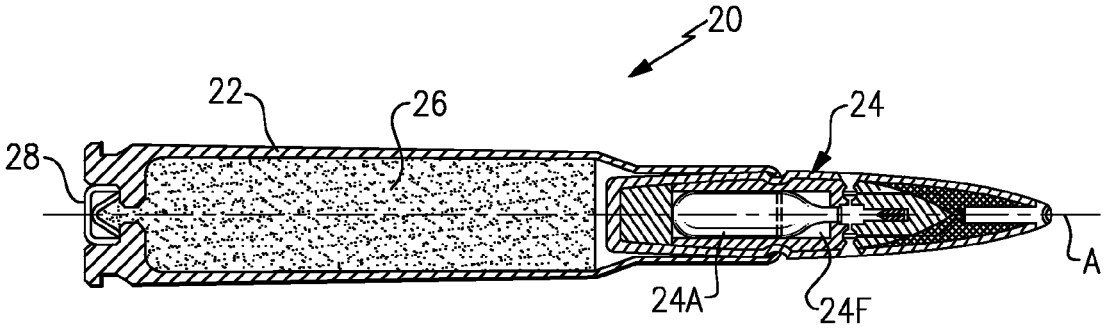
FIG. 2 is a longitudinal section of a round of ammunition.

Referring to FIG. 2, the ammunition round 20 generally includes a cartridge case 22 which fires a non-propulsive projectile 24 with a propellant 26 initiated by a primer 28. The projectile 24 is generally at least partially seated within a mouth of the case 22 such that a projectile aft portion 24A extends at least partially into the case 22 and a forward portion 24F extends out of the case 22 along a longitudinal axis A. Although a particular cased ammunition round typical of a high velocity rifle cartridge such as .50 Caliber (12.7 mm) ammunition is illustrated and described in the disclosed non-limiting embodiment, other configurations including other cased, case-less, bullets, shells, mortars, or other non-propulsive aeroshells fired by various weapon systems will also benefit herefrom.

Figure 3:
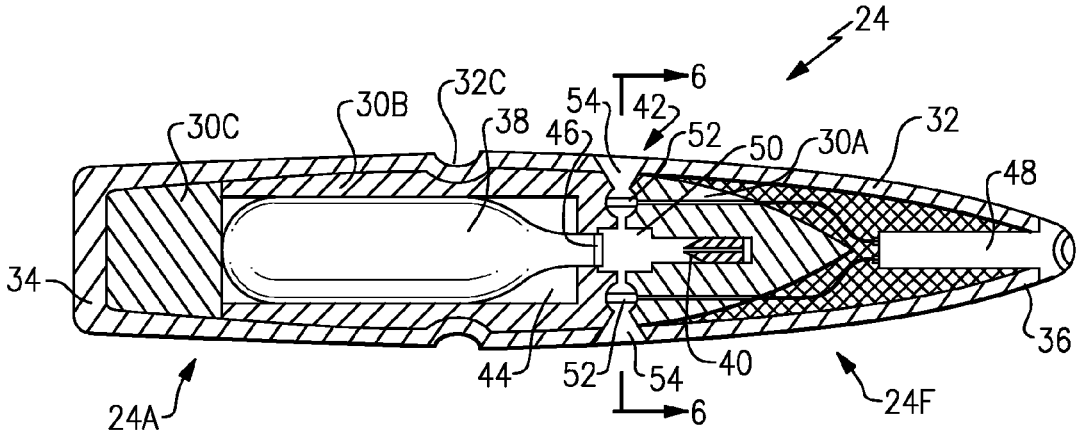
FIG. 3 is a longitudinal section of a projectile according to one non-limiting embodiment of the invention.

Referring to FIG. 3, the projectile 24 generally includes a core 30 surrounded at least in part by a jacket 32. The core 30 is typically manufactured of one or more sections (three illustrated as 30A, 30B, 30C) of a relatively heavy material such as lead, steel, tungsten-carbide or other material. That is, the core 30 may include various sections of various metals such as, for example only, an aft lead core section with a forward tungsten-carbide penetrator core section. The jacket 32 is typically manufactured of a gilding metal such as a copper alloy that includes a cannelure 32C at which the projectile 24 is seated within the mouth of the case 22. The location of the cannelure 32C generally defines the aft portion 24A and the forward portion 24F of the projectile 24. The projectile aft portion 24A includes a projectile base 34 and the projectile forward portion 24F includes a projectile nose 36 which may be of a closed tip or open tip design. Although a particular projectile configuration is illustrated and described in the disclosed non-limiting embodiment, other projectile configurations including cased, case-less, bullets, shells, mortars, or other non-propulsive aeroshells fired by various weapon systems will also benefit herefrom.

The projectile 24 further includes a storage tank 38, an initiator 40, a divert system 42 and a control system 48. The storage tank 38, the initiator 40, the divert system 42 and the control system 48 are at least partially enclosed within the jacket 32 and may be at least partially retained and positioned within a cavity 44 formed in the core 30. In the illustrated non-limiting embodiment, the multiple core sections 30A, 30B, 30C define a multi-part cavity 44 which facilitates manufacture and assembly. It should be understood that other component arrangement may also be provided. It should also be understood that the disclosure is not restricted to applications where the storage tank 38 is oriented and positioned only as illustrated in the disclosed non-limiting embodiment and that the storage tank 38 may be alternatively oriented and positioned.

The divert system 42 provides a selective communication path for a working fluid such as a compressed gas or liquid contained within the storage tank 38 to maneuver the projectile 24 in response to the control system 48. Alternatively, the working fluid may be generated from solid sources optimized through catalytic or other conditioning. Whereas the projectile 24 typically includes a multitude of components, the divert system 42 may be readily assembled into cavities defined by one or more of the sections. That is, the divert system 42 may in part be formed by a section of the core 30, the jacket 32 or some combination thereof.

The working fluid in one non-limiting embodiment is of a high molecular weight, high specific gravity, low latent heat of vaporization and low specific heat. High molecular weight provides a high momentum per mole of working fluid expended. High specific gravity provides more reaction mass within the available storage volume. Low latent heat of vaporization reduces the propellant temperature drop during expansion and ejection through the thrust nozzles. Low specific heat reduces the temperature gain during adiabatic compression when the projectile is fired at high G loads. Various combinations of these factors may be utilized to establish the working fluid state and characteristics both in the storage tank 38, and in the projectile thrust divert system. For example only, a higher pressure in the storage tank 38 may be achieved by selecting a higher CP working fluid which results in a temperature increase when launched at a high G load. Also, a higher temperature when stored within the storage tank 38 may allow use of a higher specific heat working fluid which may cool during divert system operation but still retain the advantageous thermal properties. Optimization of divert system capability can be obtained through several various working fluids, some candidates of which are detailed in Table 1:

TABLE 1

| Working fluid | Chemical Symbol | Mol. Weight | Specific Gravity | Latent Heat of Vaporization BTU/lb | Specific Heat (Cp) BTU/LB ° F. | Boiling Point ° F. |
|---|---|---|---|---|---|---|
| Helium | He | 4 | 0.124 | 8.72 | 1.25 | −452.06 |
| Neon | Ne | 20.18 | 1.207 | 37.08 | 0.25 | −244 |
| Xenon | Xe | 131.3 | 3.06 | 41.4 | 0.038 | 14 |
| Krypton | Kr | 83.8 | 2.41 | 46.2 | 0.06 | −76.4 |

TABLE 1-continued

| Working fluid | Chemical Symbol | Mol. Weight | Specific Gravity | Latent Heat of Vaporization BTU/lb | Specific Heat (Cp) BTU/LB ° F. | Boiling Point ° F. |
|---|---|---|---|---|---|---|
| Argon | Ar | 39.95 | 1.4 | 69.8 | 0.125 | −302.6 |
| Nitrogen | N2 | 28.01 | 0.808 | 85.6 | 0.249 | −410.9 |
| Air | — | 28.98 | 0.873 | 88.2 | 0.241 | −317.8 |
| Oxygen | O2 | 32 | 1.14 | 91.7 | 0.2197 | −320.4 |
| Carbon Monoxide | CO | 28.01 | 0.79 | 92.79 | 0.2478 | −312.7 |
| Nitrous Oxide | N20 | 44.01 | 1.53 | 161.8 | 0.206 | −127 |
| Sulfur Dioxide | SO2 | 64.06 | 1.46 | 167.5 | 0.149 | −53.9 |
| Propane | C3H8 | 44.1 | 0.58 | 183.05 | 0.388 | −297.3 |
| Propylene | C3H6 | 42.08 | 0.61 | 188.18 | 0.355 | −43.67 |
| Hydrogen | H2 | 2.02 | 0.071 | 191.7 | 3.425 | −423 |
| Ethylene | C2H4 | 28.05 | 0.567 | 208 | 0.399 | −154.8 |

The working fluid may be stored within the storage tank 38 as a compressed gas or liquid including but not limited to those of Table 1. In one non-limiting embodiment, the working fluid is stored between 5000 psi and 10,000 psi. It should be understand that other pressures commensurate with projectile size and divert capability may alternatively be provided.

Figure 3A:
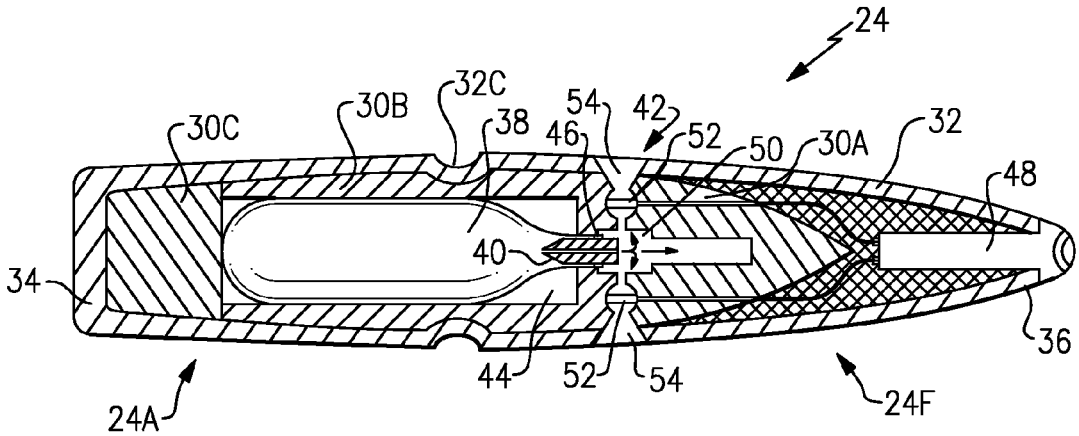
FIG. 3A is a longitudinal section of the projectile of FIG. 3 after an initial acceleration.

The working fluid is released either by the initial acceleration or at a designated time after firing of the projectile 24. In one non-limiting embodiment, the initiator 40 is represented as an acceleration activated relative displacement between the storage tank 38 and the initiator 40 (FIG. 3A). That is, either or both of the storage tank 38 and the initiator 40 are relatively movable in response to firing of the projectile 24. The initiator 40 in this non-limiting embodiment is a hollow punch which penetrates a plug 46 of the storage tank 38 to initiate flow of the working fluid into the divert system 42.

Figure 4:
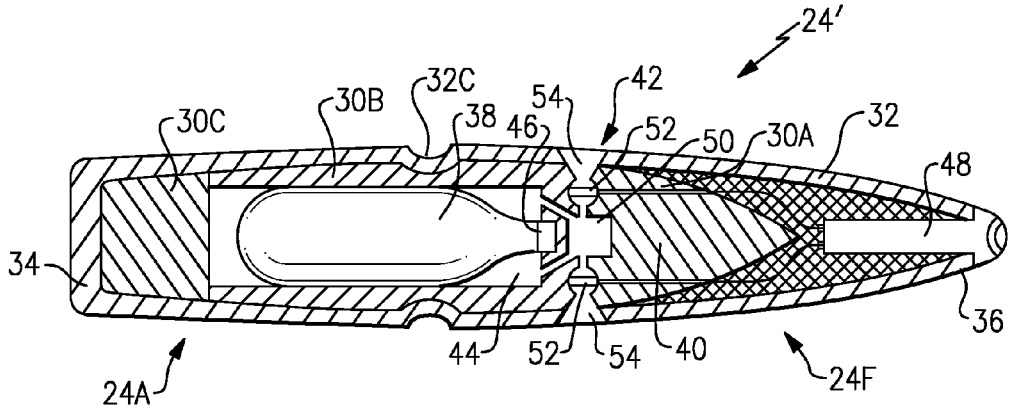
FIG. 4 is a longitudinal section of another projectile according to another non-limiting embodiment of the invention.
Figure 4A:
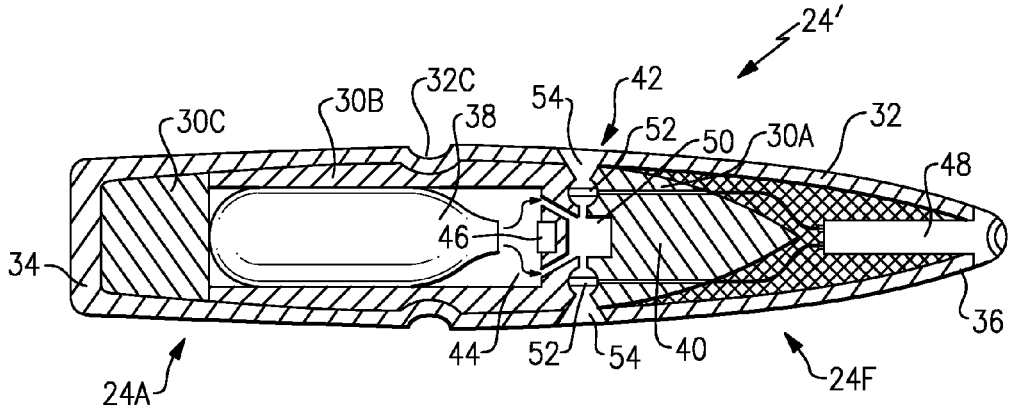
FIG. 4A is a longitudinal section of the projectile of FIG. 4 after an initial acceleration.

Alternatively, the plug 46 is dislodged from the storage tank 38 in response to firing of a projectile 24' (FIG. 4). In one non-limiting embodiment, the storage tank 38 is positioned such that the plug 46 is directed toward the nose of the projectile 24' and retained within core portion 30B. The plug 46 may be bonded crimped, or otherwise retained within core portion 30B such that an initial acceleration of the projectile 24' causes the storage tank 38 to move aft relative to the core portion 30B (FIG. 4A) which separates the plug 46 from the storage tank 38 and thereby releases the working fluid into the divert system 42. Alternatively, the plug 46 bursts in response to firing without movement of the tank 38 being required.

Figure 5:
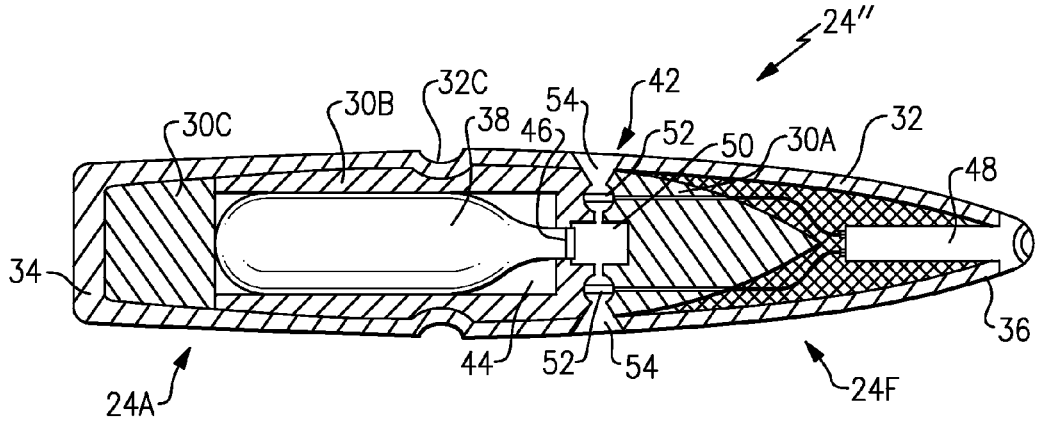
FIG. 5 is a longitudinal section of another projectile according to another non-limiting embodiment of the invention.
Figure 5A:
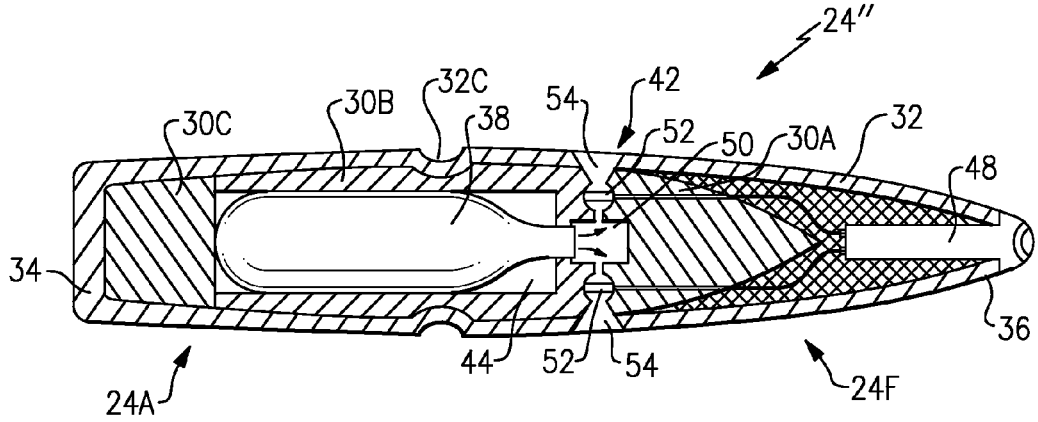
FIG. 5A is a longitudinal section of the projectile of FIG. 5 after an initial acceleration.

Alternatively, the plug 46 is of an electro-mechanical or chemical composition which opens in response to firing of the projectile 24" (FIG. 5). In one non-limiting embodiment, the propellant 26 (FIG. 2) is communicated into the projectile 24" through the divert system 42 when the projectile 24" is fired to essentially burn out the plug 46 (FIG. 5A). As the plug 46 is burned-out, a delay is thereby generated between firing of the projectile 24" and release of the working fluid. In one non-limiting embodiment, the divert system 42 may be in an initially open position to receive the propellant 6 therein for receipt onto the plug 46.

Figure 6:
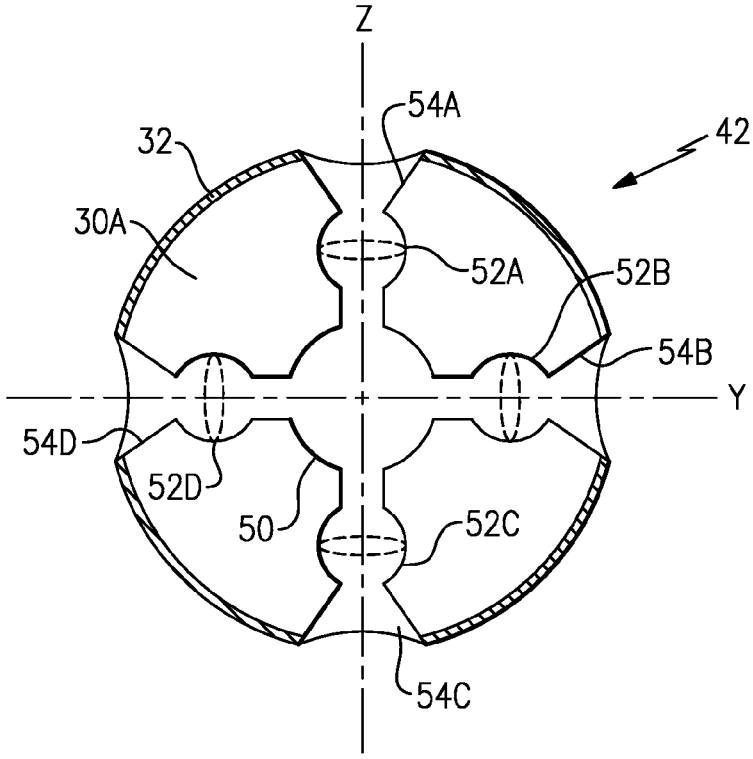
FIG. 6 is a sectional view of the projectile of FIG. 3 taken along line 6-6 to illustrate the divert system.

The divert system 42 generally includes an accumulation manifold 50 which communicates with a multiple of valves 52A-52D which independently control communication of the working fluid to a respective nozzle 54A-54D located about the projectile circumference (FIG. 6) to maneuver the projectile 24 in response to the control system 48. The accumulation manifold 50 receives the working fluid upstream of the multiple of valves 52A-52D such that the working fluid may be readily available to any nozzle 54A-54D in response to opening of the respective valve 52A-52D. It should be understood that the nozzle 54A-54D may be activated individually or in concert. Furthermore, the valve 52A-52D may be normally open or normally closed.

The timing and operating frequency of the valves 52A-52D are selected to projectile requirements. For example only, a spinning projectile fired from a rifled barrel will require a more rapid operating frequency and more precise timing than that of a non-spinning projectile such as that fired from a smooth bore barrel.

Figure 7:
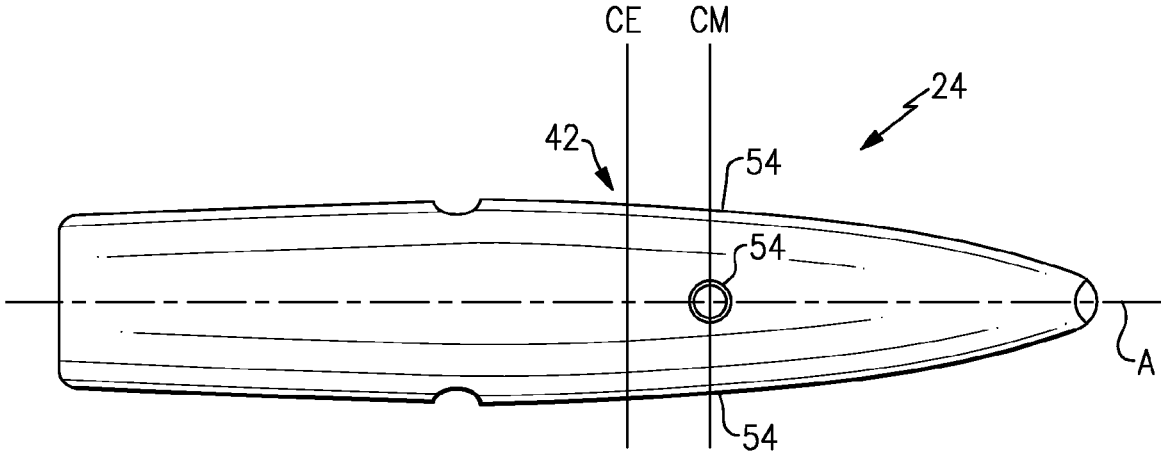
FIG. 7 is a side view of a guided projectile with a CM and CE identification.

Each nozzle 54A-54D, in one non-limiting embodiment, is located at or near the center of mass (CM) which is longitudinally forward of the center of effort (CE) of the projectile 24 (FIG. 7) as the static stability of the projectile is determined by the relationship of the CE and the CM. The resultant air resistance is a force parallel to the trajectory and applied at the CE. It should be understood that other positions for each nozzle 54A-54D may be determined at least in part by projectile stability derivatives and projectile application requirements. Since the storage tank 38 and working fluid therein are of a lower density than the core 30 of the projectile 24, the storage tank 38 will facilitate a more forward CM movement as the storage tank 38 empties to thereby generally increase projectile 24 stability. Additional features such as fins, aspect ratio, dimples, or other features may additionally be provided to further increase stability.

By directing the divert thrust through the CM, the projectile 24 is laterally translated with minimal rotation. By directing the thrust slightly forward of the CM a rotation of the projectile 24 to turn the nose 36 in the direction of translation allows further aerodynamic divert to augment the lateral translation.

Figure 8:
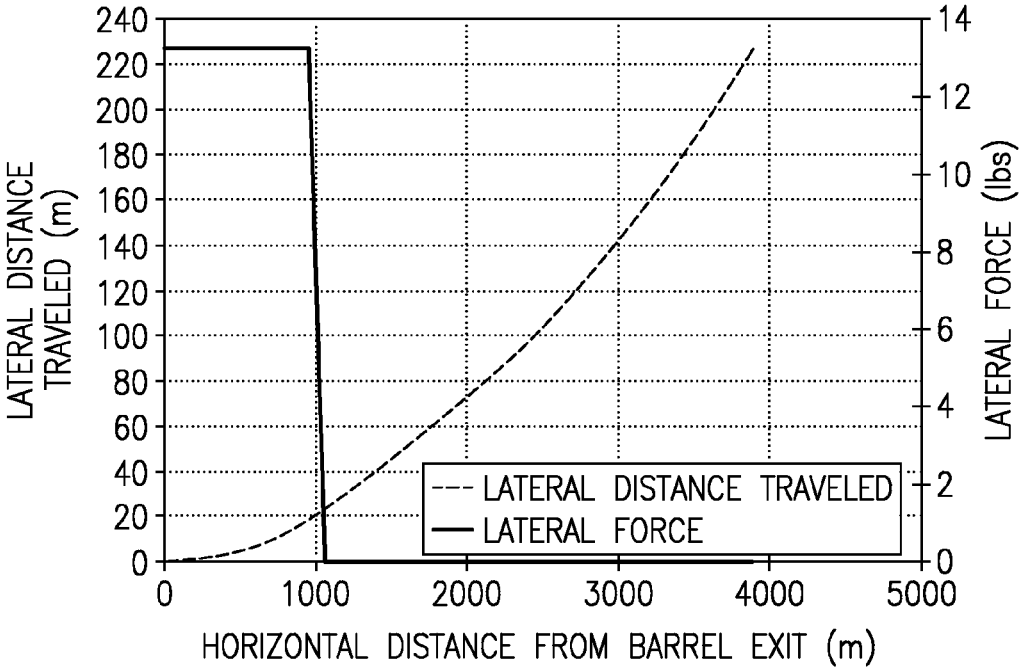
FIG. 8 is a graph of a Lateral Distance vs. Distance from Barrel in which a lateral force from the divert system is actuated for the first 1 km.
Figure 9:
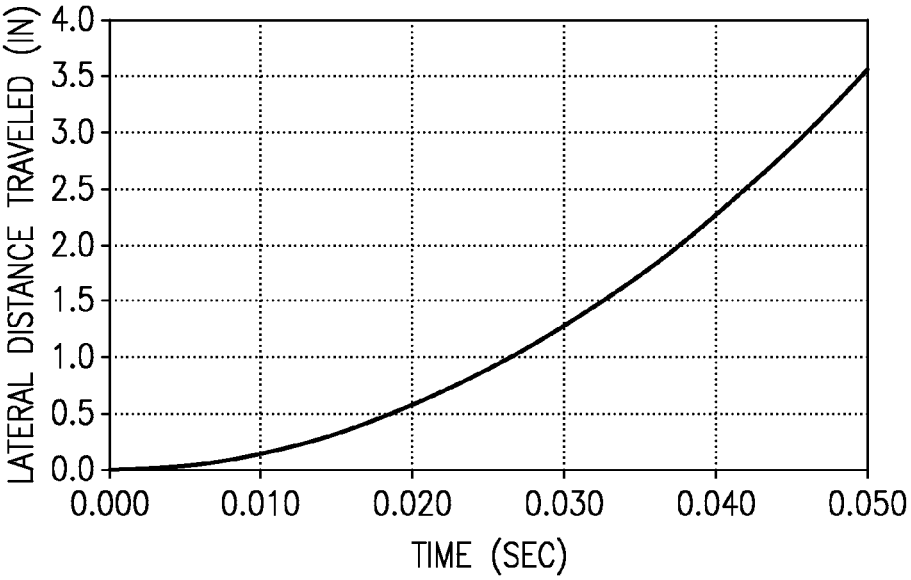
FIG. 9 is a graph of a Lateral Distance vs. Time for the first 50 msec in which a lateral force from the divert system is actuated for the first 1 km.

FIGS. 8 and 9 illustrate a representative maximum lateral divert capability for a representative projectile which has a maximum range of almost four thousand (4000) meters (13,123 feet). FIG. 8 illustrates the actuation of but a single nozzle for approximately one thousand (1000) meters (3280 feet) or one-fourth of the total range to illustrate the resultant projectile trajectory change. While FIGS. 8 and 9 illustrate a representative lateral divert, a typical application would typically include multiple short actuations of various nozzle 54A-54D to improve targeting accuracy rather than a divert thrust in a singular direction. As illustrated in the graph of FIG. 8, the projectile will accelerate in the lateral direction even after the single nozzle is deactivated. In one example, the actuation of but a single nozzle for approximately one thousand (1000) meters (3280 feet) for a divert force results in an approximate 20 m (66 feet) lateral divert distance over the first one thousand (1000) meters (3280 feet) traveled by the projectile 24 and an approximate 250 m (820 feet) lateral divert distance over the four thousand (4000) meters (13,123 feet) traveled by the projectile 24. In another example, the actuation of but a single nozzle for the entire our thousand (4000) meters (13,123 feet) traveled by the projectile 24 results in an approximate 20 m (66 feet) lateral divert distance over the first one thousand (1000) meters (3280 feet) traveled by the projectile 24 and an approximate 880 m (2887 feet) lateral divert distance over the entire four thousand (4000) meters (13,123 feet) traveled by the projectile 24.

Figure 10:
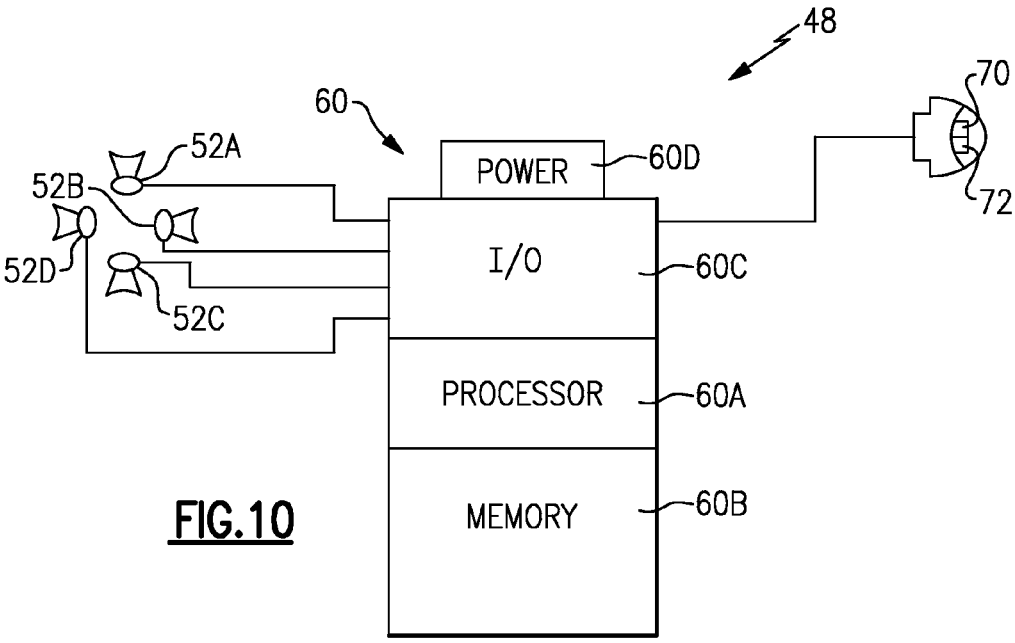
FIG. 10 is a schematic view of a control system for a projectile according to a non-limiting embodiment of the invention.
Figure 11:
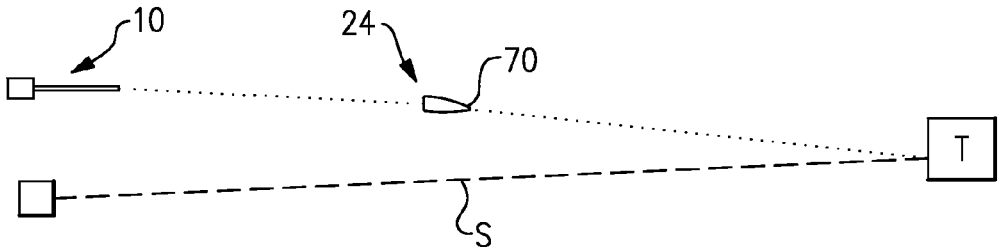
FIG. 11 is a schematic view of a designated guided projectile engagement according to one non-limiting embodiment of the invention.
Figure 12:
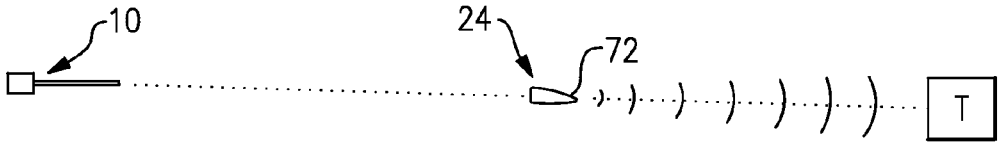
FIG. 12 is a schematic view of a fire-and-forget guided projectile engagement according to another non-limiting embodiment of the invention.

Referring to FIG. 10, the control system 48 includes a module 60 such as single chip microcomputer with a processor 60A, a memory 60B, an input-output interface 60C, and a power subsystem 60D formed as a monolithic component. The processor 60A may be any type of known microprocessor having desired performance characteristics. The memory 60B may, for example only, include electronic, optical, magnetic, or any other computer readable medium onto which is stored data and control algorithms. The interface 60C communicates with the valve 52A-52D and other system such as a sensor system 70. The sensor system 70 facilitates guidance of the projectile 24 through an externally provided control signal S such as that provided by, for example only, a laser or radar designator (FIG. 11) which is trained on the target T. Furthermore, the sensor 70 may alternatively or additionally include a fire-and-forget sensor system 72 such as, for example only, an infrared sensor which does not require the target T be designated after firing of the projectile (FIG. 12).

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit from the instant invention.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present invention are possible in light of the above teachings. The disclosed embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A divert system for a non-propulsive projectile comprising:

an accumulation manifold operable to receive a working fluid stored under pressure within a storage tank in response to an acceleration of the projectile;

a multiple of valves in communication with said accumulation manifold; and a nozzle downstream of each of said multiple of valves.

2. A divert system for a non-propulsive projectile comprising:

an accumulation manifold operable to receive a working fluid stored under pressure within a storage tank:

a multiple of valves in communication with said accumulation manifold:

a nozzle downstream of each of said multiple of valves; and an initiator adjacent said storage tank, at lest one of said initiator and said storage tank relatively movable to the other of said initiator and said storage tank to selectively release the working fluid from said storage tank in response to an acceleration of the projectile.

3. A divert system for a non-propulsive projectile comprising:

an accumulation manifold operable to receive a working fluid stored under pressure within a storage tank:

a multiple of valves in communication with said accumulation manifold:

a nozzle downstream of each of said multiple of valves; and a plug which seals said storage tank, said plug dislodgeable from said storage tank to release the working fluid from said storage tank in response to an acceleration of the projectile.

4. A divert system for a non-propulsive projectile comprising:

an accumulation manifold operable to receive a working fluid stored under pressure within a storage tank:

a multiple of valves in communication with said accumulation manifold:

a nozzle downstream of each of said multiple of valves; and a burst disk which seals said storage tank, said burst disk operable to release the working fluid from said storage tank in response to adiabatic compression which causes increased pressure.

5. The system as recited in claim 1, wherein said initiator activates immediately upon firing of the projectile from a cartridge case.

6. The system as recited in claim 1, further comprising an initiator operable to release said working fluid from said storage tank into said accumulation manifold in response to said acceleration of the projectile.

7. The system as recited in claim 6, wherein said initiator comprises a hollow punch to initiate flow of the working fluid therethrough.

8. The system as recited in claim 6, wherein said initiator activates at a predetermined time after firing of the projectile from a cartridge case.

9. A non-propulsive projectile comprising:

a control system;

an accumulation manifold operable to receive a working fluid stored under pressure within a storage tank in response to an acceleration of the projectile; and a multiple of valves in communication with said accumulation manifold to selectively release a working fluid through at least one of said multiple of valves to maneuver the projectile in response to said control system.

10. The non-propulsive projectile as recited in claim 9, wherein said projectile is a non-spin stabilized .50 caliber projectile.

11. The non-propulsive projectile as recited in claim 9, further comprising a sensor system in communication with said control system to maneuver the projectile in response to an externally provided control signal.

12. The non-propulsive projectile as recited in claim 9, further comprising a fire-and-forget sensor system in communication with said control system to maneuver the projectile in response to the fire-and-forget sensor system.

13. The non-propulsive projectile as recited in claim 9, further comprising a nozzle downstream of each of said multiple of valves.

14. The non-propulsive projectile as recited in claim 13, wherein each of said nozzles are located at a center of mass of said projectile.

15. The non-propulsive projectile as recited in claim 9, further comprising an initiator operable to release said working fluid from said storage tank into said accumulation manifold in response to said acceleration of the projectile.

16. The non-propulsive projectile as recited in claim 9, further comprising a core which defines a cavity which contains said storage tank.

17. The non-propulsive projectile as recited in claim 16, further comprising a jacket which at least partially surrounds said core, said jacket defines a cannelure.

18. A method of maneuvering a non-propulsive projectile comprising:

releasing a working fluid from a storage tank contained within a projectile into an accumulation manifold upstream of a multiple of valves in response to an acceleration of the projectile, the working fluid selectively released from the accumulation manifold through a divert system to provide a selective communication path for the working fluid to maneuver the projectile in response to a control system.

19. A method as recited in claim 18, further comprising:

releasing the working fluid into the accumulation manifold upstream of a multiple of valves upon firing of the projectile from a cartridge case.

20. A method as recited in claim 18, further comprising: controlling the multiple of valves to maneuver the projectile in response to an externally provided control signal.

21. The non-propulsive projectile as recited in claim 15, further comprising a nozzle located at a center of mass of said projectile downstream of each of said multiple of valves.

22. The non-propulsive projectile as recited in claim 9, further comprising a nozzle located at a center of mass of said projectile downstream of each of said multiple of valves.

23. A method as recited in claim 18, wherein the acceleration of the projectile is in response to firing the projectile with a propellant which provides the motive force to the projectile.

* * * * *